US007059485B1

(12) United States Patent
Reidenbach

(10) Patent No.: US 7,059,485 B1
(45) **Date of Patent: *Jun. 13, 2006**

(54) TAMPER-RESISTANT BOTTLE CLOSURE

(76) Inventor: Bryan L. Reidenbach, 26 Northern Dr., Millersburg, OH (US) 44654

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,296

(22) Filed: Jun. 3, 1999

(51) Int. Cl.
*B65D 41/34* (2006.01)

(52) U.S. Cl. ..... 215/252

(58) Field of Classification Search ..... 215/252, 215/235, 306
See application file for complete search history.

(56) References Cited

U.S. PATENT DOCUMENTS

| | | | | | |
|---|---|---|---|---|---|
| 4,394,918 | A | * | 7/1983 | Grussen | 215/252 |
| 4,402,418 | A | * | 9/1983 | Ostrowsky | 215/252 |
| 4,749,095 | A | * | 6/1988 | Rote | 215/252 |
| 4,801,030 | A | * | 1/1989 | Barriac | 215/252 |
| RE32,879 | E | * | 2/1989 | Wright et al. | 215/252 |
| 5,004,112 | A | * | 4/1991 | McBride | 215/252 |
| 5,096,079 | A | * | 3/1992 | Odet | 215/252 |
| 5,215,204 | A | * | 6/1993 | Beck et al. | 215/252 |
| 5,328,044 | A | * | 7/1994 | Rohrs et al. | 215/252 |
| 5,450,973 | A | * | 9/1995 | Ellis et al. | 215/252 |
| 5,465,858 | A | * | 11/1995 | Gargione | 215/252 |
| 5,501,349 | A | * | 3/1996 | McCandless | 215/252 |
| 5,609,262 | A | * | 3/1997 | Trout | 215/252 X |
| 5,725,115 | A | * | 3/1998 | Bosl et al. | 215/252 |
| 5,749,484 | A | * | 5/1998 | Trout | 215/252 |
| 6,276,543 | B1 | * | 8/2001 | German et al. | 215/252 |

FOREIGN PATENT DOCUMENTS

| | | | | |
|---|---|---|---|---|
| DE | 4433238 | * | 1/1996 | |
| EP | 541466 | * | 5/1993 | 215/252 |

* cited by examiner

*Primary Examiner*—Nathan J. Newhouse
(74) *Attorney, Agent, or Firm*—Sand & Sebolt

(57) ABSTRACT

A tamper-resistant bottle cosure includes a cap and a breakaway skirt connected by a plurality of frangible links and inhibits tampering with the fluid contents of the bottle. A stopping ledge extending outward from the bottle neck retains the breakaway skirt, thus breaking the frangible links when the cap is removed. The breakaway skirt includes a number of inner skirts, a security ring which wraps around the bottle, a number of securing straps, and a plurality of security fins which further inhibit tampering with the closure. A second embodiment includes a plurality of inner skirts that alternately attach distal to and proximate from the frangible links. A third embodiment includes a first set of inner skirts extending around to a first stopping ledge and a second set of inner skirts extending around a second stopping ledge. A fourth embodiment includes an intermediate link interposed between the wing and the inner protuberance of the inner skirts. A fifth embodiment includes inner skirts which do not include wings extending around the stopping ledge. A sixth embodiment includes inner skirts having a blocking protrusion and a clamping protrusion. A seventh embodiment includes a connection strap extending between the cap and the breakaway skirt.

13 Claims, 14 Drawing Sheets

FIG-1
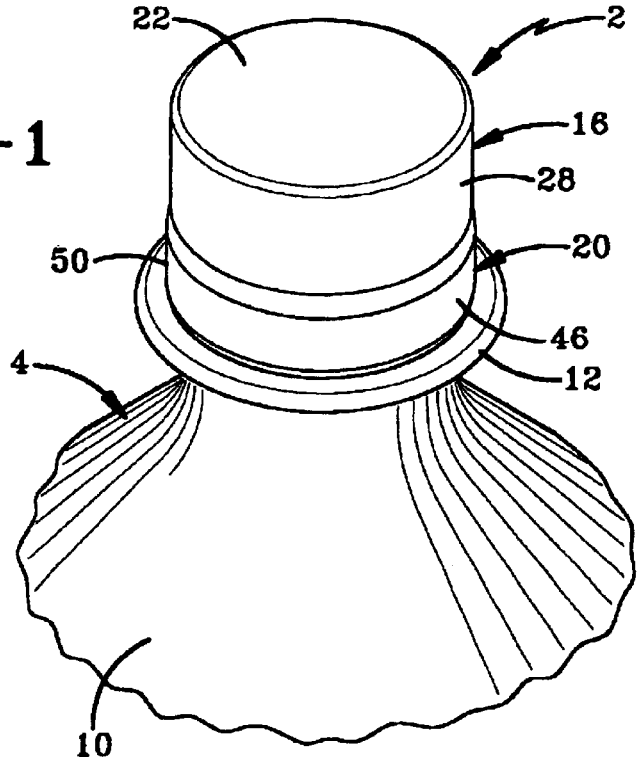
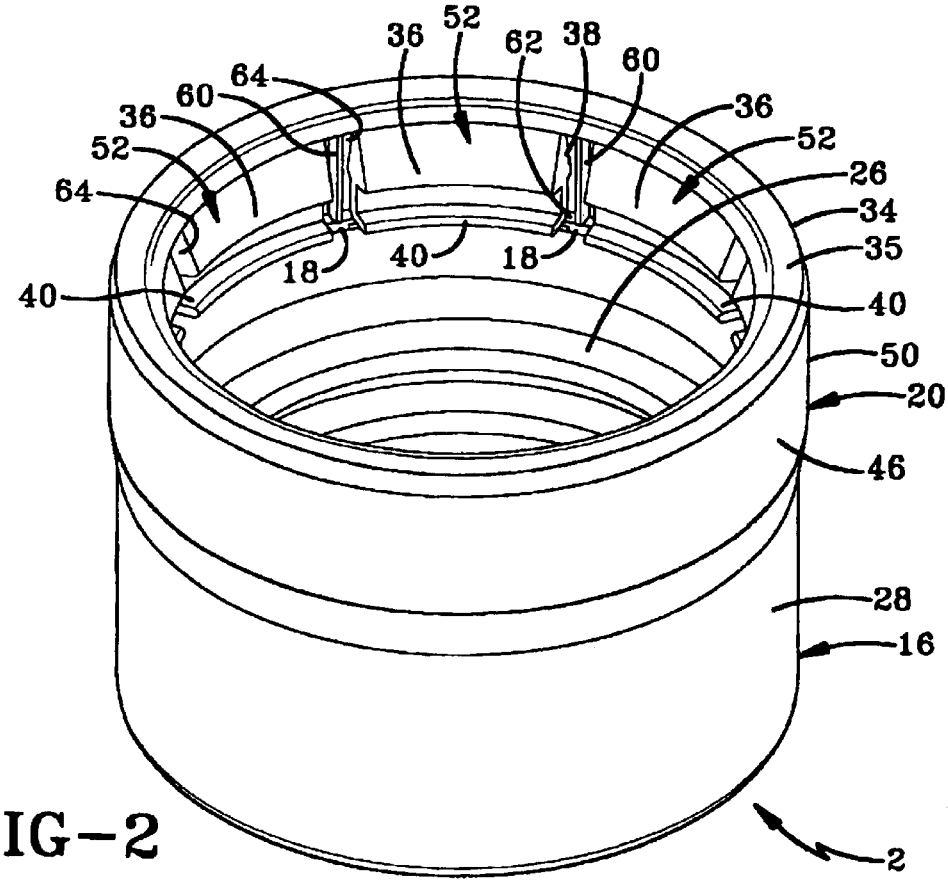
FIG-2

TAMPER-RESISTANT BOTTLE CLOSURE

BACKGROUND OF THE INVENTION

1. Technical Field

The subject invention is generally directed to a closure for a container. More particularly, the invention relates to a tamper-resistant closure for a container. Specifically, the invention relates to a closure for providing resealable access to the contents of a container while inhibiting tampering therewith and indicating the existence of such tampering or the fact that the closure has been removed from the container, 2. Background of the Invention Various containers for storing and transporting fluid such as water have been known and used for thousands of years. Prior to modem times, water containers were a necessity since homes and businesses did not have running water, and containers were, therefore, needed to transport water from the local well to each house or business.

Many closures for containers have been developed including lids, corks, snap-on caps, and screw caps. Since man's discovery that fluids could be stored within containers for later use, new and better means for closing, sealing, or otherwise controlling fluid flow into and out of the container have been sought.

More recently, i.e., over approximately the past 100 years, a phenomenal growth in the distribution of bottled beverages has occurred. The storage of beverages such as milk, juice, water, carbonated beverages, iced tea, and alcoholic beverages in containers such as cartons, bottles, flasks, or jugs made from paper, plastic, or glass has flourished.

Specifically, these various containers include plastic milk cartons, 12-ounce cans, 16- and 20-ounce plastic bottles, 1- and 2-liter plastic bottles, and other such containers.

Bottled beverages typically come in either plastic or glass bottles with metal or plastic closures sealing the beverage therein until the time for consumption. These containers typically include a narrowing neck with a fluid access opening therein. A number of closures have been used to cover this fluid access opening including metal lids requiring a bottle opener to remove, twist off metal lids, snap-on/off plastic caps, screw-on/off plastic caps, and pull up and push down type caps. These caps all serve to provide access to the fluid contained within the container. The closure is preferably reusable in that it may be removed from and replaced onto the container thereby allowing only a portion of the fluid contained within the container to be used at a given sitting.

The need for closure of these containers is historically based upon a number of concerns including spillage, spoilage, evaporation, and contamination of the fluid contained within the container. More recent designs continue to take into account these historical needs as well as today's desired qualities such as ease and speed of use, and retention of carbonation.

While the resealable aspect possessed by many of these closures is highly desirable, the benefit obtained thereby must be weighed against the risk that an interloper might remove the closure, tamper with the contents of the container, and reseal the container using the resealable closure with the intent that an unwary or unsuspecting consumer may thereafter reopen the container and consume the contaminated contents contained therein. The need exists for a resealable bottle closure which inhibits tampering, yet remains simple to remove and install.

SUMMARY OF THE INVENTION

Objectives of the invention include providing a container closure for providing resealable access to the fluid contents of a container, while inhibiting tampering with the contents of the container.

Another objective of the invention is to provide a resealable closure which can be removed and replaced on the bottle with ease.

Another objective of the invention is to make evident the existence of any tampering which may have occurred.

Another objective of the invention is to provide a closure which, when fully tightened down, seals off the fluid access opening thereby.

A further objective is to provide a closure which is of simple construction which achieves the stated objectives in a simple, effective, and inexpensive manner, and which solves problems and satisfies needs existing in the art.

These and other objectives and advantages of the invention are obtained by the improved closure, the general nature of which may be stated as a threaded cap connected through a frangible link to a breakaway skirt.

BRIEF DESCRIPTION OF THE DRAWINGS

The preferred embodiments of the invention, illustrative of the best modes in which applicant has contemplated applying the principles of the invention, are set forth in the following description and are shown in the drawings and are particularly and distinctly pointed out and set forth in the appended claims.

FIG. 1 is a perspective view of a first embodiment of the closure of the present invention installed on a bottle;

FIG. 2 is a perspective view of the underside of the first embodiment;

Similar numerals refer to similar parts throughout the specification.

DESCRIPTION OF THE PREFERRED EMBODIMENTS

Figure 3:
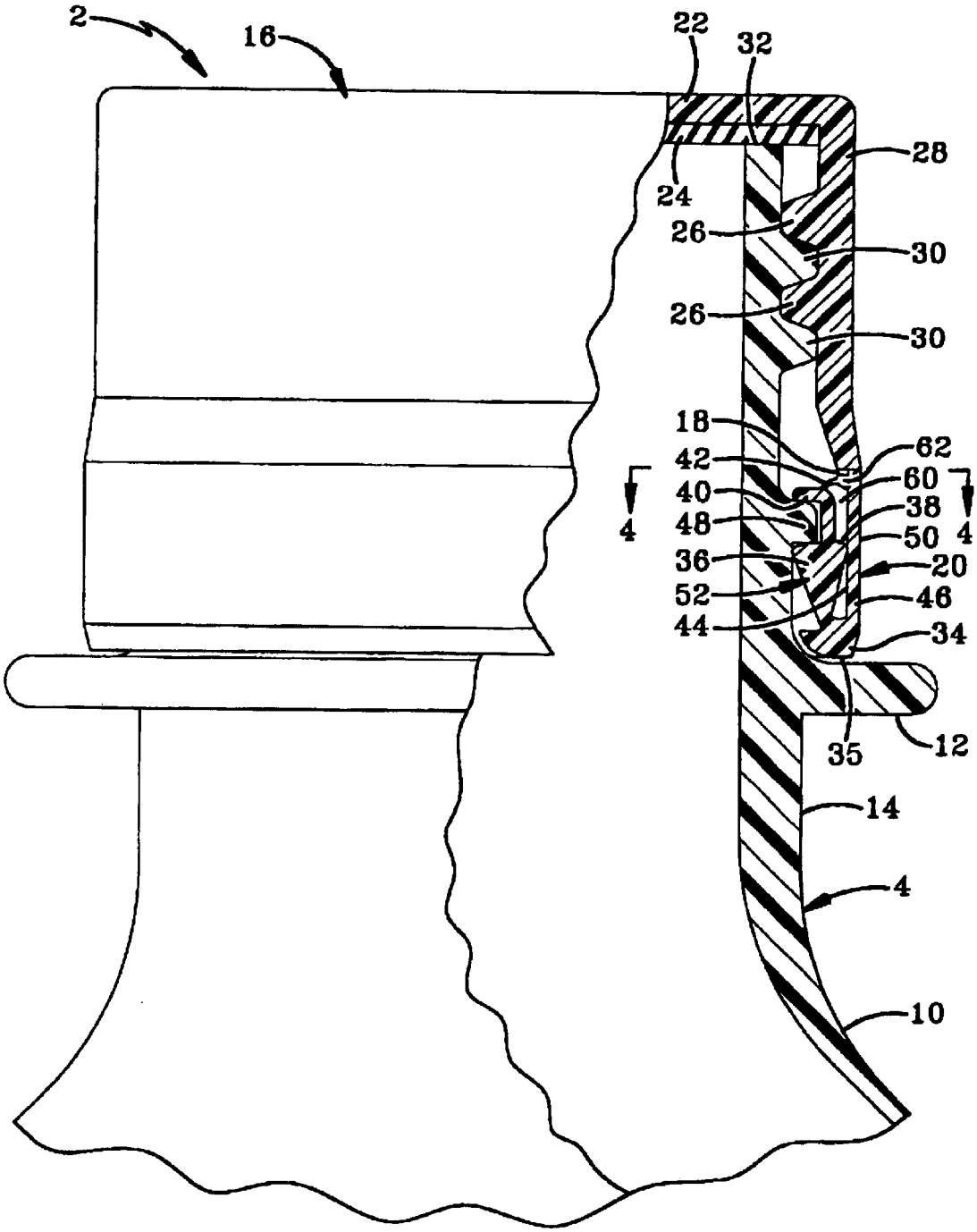
FIG. 3 is a view of the bottle opening and the first embodiment partially in section.

The improved tamper-resistant bottle closure of the present invention is indicated generally at the numeral 2 in the accompanying drawings. The intended use of closure 2 is as a closure for a container 4 as depicted in FIG. 1. Closure 2 is also capable of indicating whether or not closure 2 has been removed from container 4 after its initial installation.

In the preferred embodiments, closure 2 is carried by container 4. Container 4 includes a main body 8, a neck 10, and a nozzle 14, all of which may be integrally formed. Main body 8 is the reservoir within which the liquid contents are retained. Neck 10 is a funnel-shaped member whereby main body 8 contracts into nozzle 14. Nozzle 14 is a hollow cylindrical member having a security flange 12 and a stopping ledge 48. Nozzle 14 connects at a lower end to neck 10 and terminates at an upper end at an annular edge 32. Nozzle 14 is disposed inwardly of closure 2.

Nozzle 14 has a plurality of external threads 30 formed thereon. Stopping ledge 48 is an annular protrusion extending outwardly from nozzle 14 having a lower edge 58, an arcuate outer edge 54, and an upper edge 56. The transition between upper edge 56 and outer edge 54 is preferably curved to facilitate the installation of closure 2 onto container 4. Stopping ledge 48 is positioned below threads 30 such that threads 30 are interposed between stopping ledge 48 and edge 32. Security flange 12 is an annular protrusion extending outwardly from nozzle 14 below stopping ledge 48 with an outer radial dimension greater than the outer radial dimension of stopping ledge 48.

Closure 2 includes a cap 16, a plurality of frangible links 18, and a breakaway skirt 20. Frangible links 18 are interposed between cap 16 and breakaway skirt 20. Cap 16 includes a sidewall 28 of a substantially cylindrical section which is abutted at a first end by a circular lid 22 of approximately the same thickness as sidewall 28, with lid 22 being circumferentially attached to sidewall 28. Cap 16 further includes a gasket 24 which lies adjacent a face of lid 22 which abuts sidewall 28. Gasket 24 is a thin, flat, circular body of an outer diameter at least that of the outer diameter of edge 32. Gasket 24 is typically manufactured of a tough, resilient, waterproof material such as polyethylene, although other materials may be used without departing from the spirit of the present invention. Sidewall 28 is formed with a plurality of internal threads 26 which cooperate threadably with external threads 30.

Frangible links 18 provide a breakable connection between cap 16 and breakaway skirt 20. In the preferred embodiments, frangible links 18 are integrally formed with cap 16 and breakaway skirt 20. Frangible links 18 are thin-walled members which break upon the application of nominal tensile or shear stresses, such as the stresses caused by the removal of cap 16 or the deflection of breakaway skirt 20. In the preferred embodiments, frangible links 18 are circumferentially spaced and distributed about closure 2.

Breakaway skirt 20 includes an outer skirt 46, a plurality of inner skirts 52, a security ring 34, a plurality of securing straps 42, a terminal flange 62, and a plurality of security fins 60. Outer skirt 46 is a hollow roughly cylindrical body containing an inner surface 44 and an outer surface 50. Outer skirt 46 is attached at an upper end to frangible links 18, and is attached at a lower end to security ring 34.

As can be seen in FIGS. 5–8, security ring 34 is a roughly toroid-shaped body having a circumferential attachment to outer skirt 46 and having a convex lower surface 35. As can be seen in the accompanying drawings, security ring 34 projects inwardly toward nozzle 14 to inhibit tampering with the contents of container 4.

Security ring 34 is additionally attached to a plurality of inner skirts 52 that are interposed between outer skirt 46 and nozzle 14. Each inner skirt 52 contains an inner protuberance 36, an outer protuberance 38, and a wing 40. Innerskirts 52 are circumferentially distributed about breakaway skirt 20 and are circumferentially spaced with gaps 64 therebetween. Inner protuberance 36 projects inward toward nozzle 14. Outer protuberance 38 extends outward toward outer skirt 46. Inner protuberance 36 and outer protuberance 38 are of such dimension that when closure 2 is installed on container 4, inner protuberance 36 rests closely adjacent nozzle 14 and outer protuberance 38 rests closely adjacent inner surface 44. Inner protuberance 36 and outer protuberance 38 may additionally be of sufficient size to generate an interference fit between nozzle 14 and outer skirt 46 without departing from the spirit of the present invention.

Figure 8:
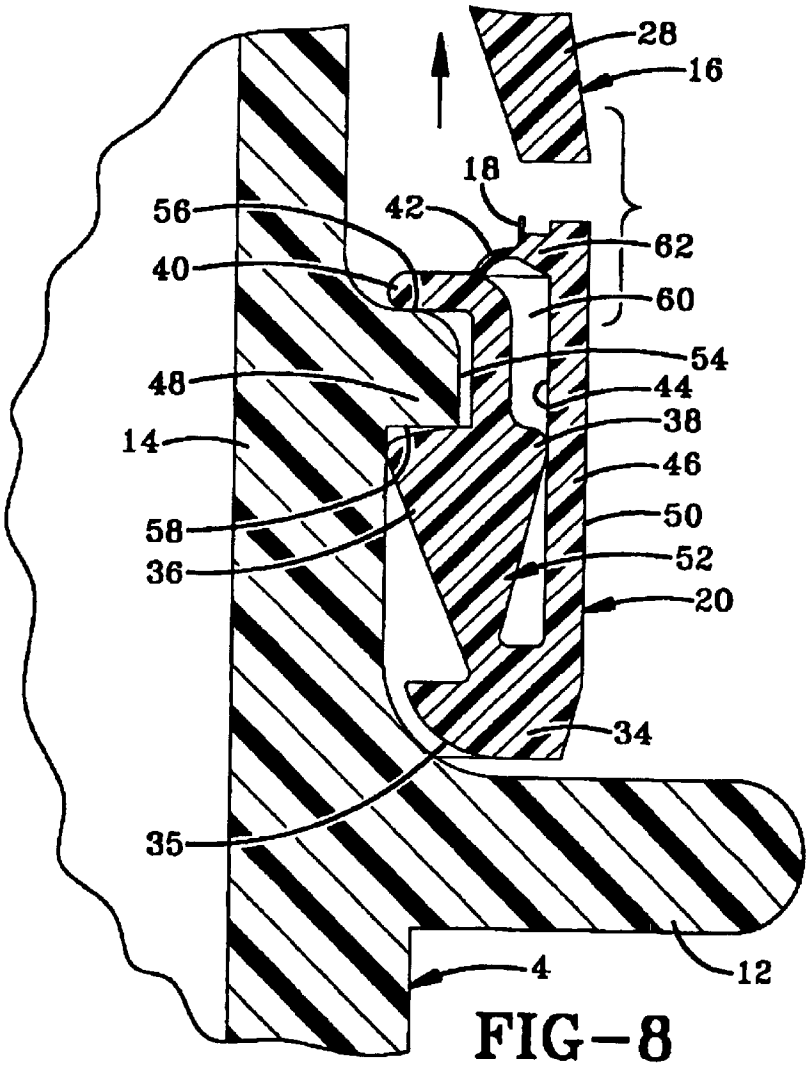
FIG. 8 is a sectional view similar to FIG. 7 showing separation of the cap portion from the breakaway skirt.
Figure 7:
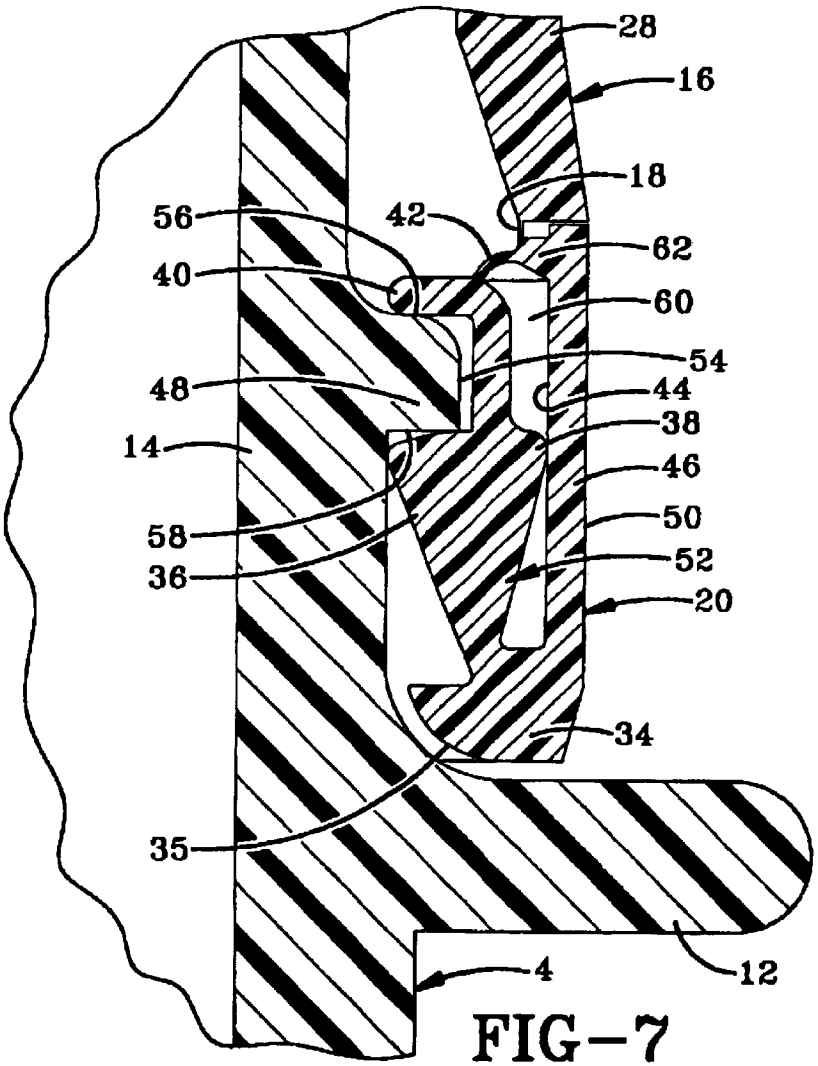
FIG. 7 is a sectional view indicating final installation of the first embodiment on a bottle.

When closure 2 is installed on container 4, inner protuberance 36 rests closely adjacent both container 4 and lower edge 58 (see FIGS. 7–8). Wing 40 is attached to inner skirt 52 at a location distal from the connection of inner skirt 52 with security ring 34. Wing 40 projects upwardly from inner skirt 52 and thereafter inwardly such that wing 40 wraps around and lies closely adjacent outer edge 54 and upper edge 56 of stopping ledge 48. Securing straps 42 attach between wings 40 and outer skirt 46 with securing straps 42 being attached to outer skirt 46 at a location proximate frangible links 18.

Figure 4:
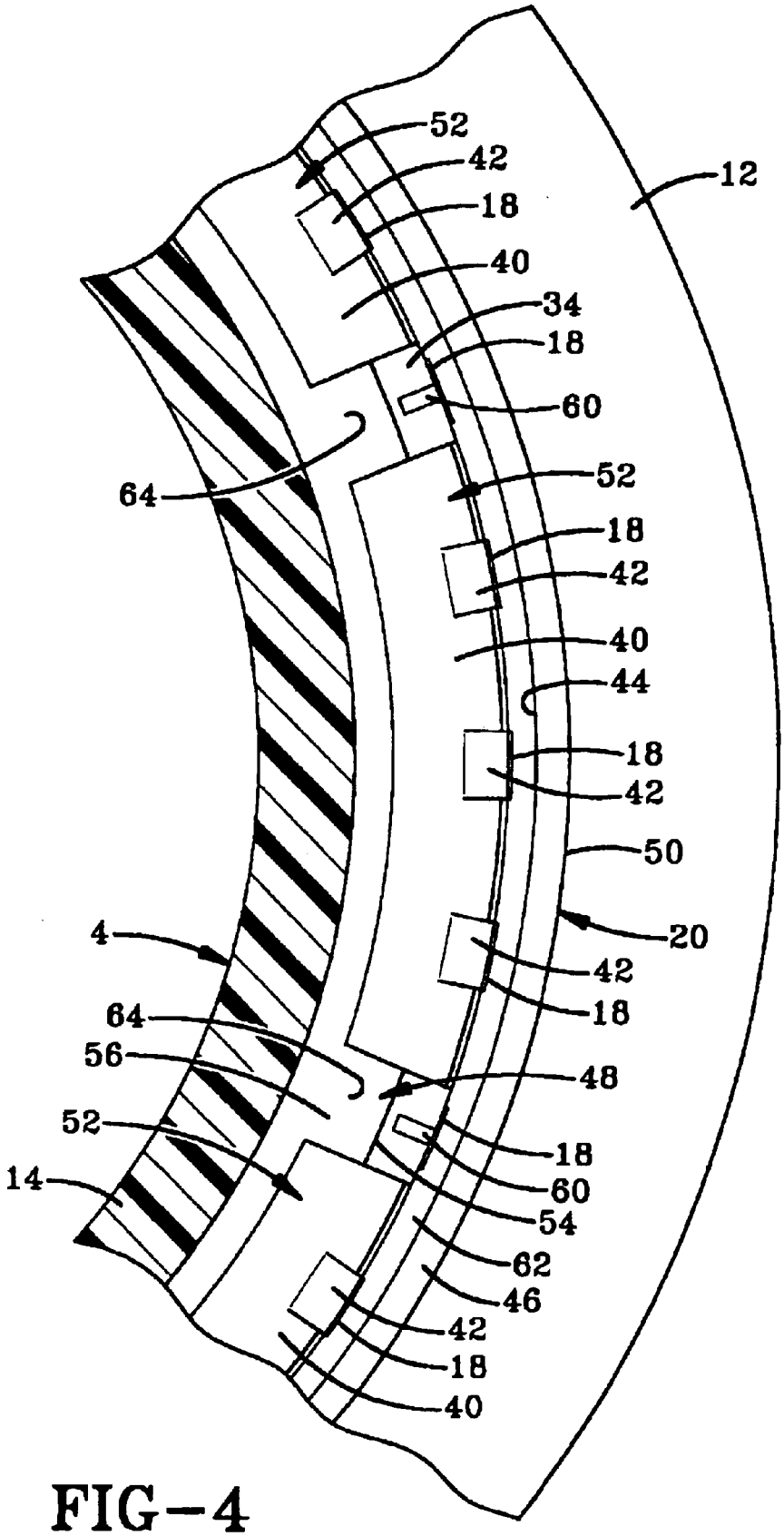
FIG. 4 is a sectional view as indicated by section line 4—4 in FIG. 3.

Security fins 60 are planar members projecting radially inward from inner surface 44 and interposed between inner skirts 52 within gaps 64 (see FIG. 4). Security fins 60 attach to inner surface 44 and project radially inward from inner surface 44 substantially, but not entirely, the distance to outer edge 54 of stopping ledge 48. Security fins 60 extend substantially the length of outer skirt 46 and terminate at a lower end with an attachment to security ring 34. Security fins 60 terminate at an upper end with an attachment to terminal flange 62. Terminal flange 62 is a circumferential protuberance extending inwardly from inner surface 44.

When closure 2 is fully installed on container 4, internal threads 26 are threaded with external threads 30 and gasket 24 is sandwiched firmly between lid 22 and edge 32 to form a watertight seal. Lower surface 35 lies closely adjacent security flange 12 to inhibit tampering with the contents of container 4 by inserting an object between security ring 34 and nozzle 14.

The unthreading of cap 16 from nozzle 14 causes cap 16 to be threadably urged in the upward direction away from stopping ledge 48. In accordance with the objectives of the present invention, however, lower edge 58 of stopping ledge 48 restrains inner protuberance 36 from upward movement, thus retaining breakaway skirt 20 on nozzle 14. Further in accordance with the features of the present invention, the retention of breakaway skirt 20 on stopping ledge 48 during upward movement of cap 16 causes a tensile force between cap 16 and breakaway skirt 20 through frangible links 18. The tensile force in frangible links 18 ultimately causes frangible links 18 to fracture, thus causing breakaway skirt 20 to separate from cap 16 and thus causing breakaway skirt 20 to be retained on stopping ledge 48 after cap 16 has been removed from container 4.

In accordance with the objectives of the present invention, securing straps 42 attached between wings 40 and outer skirt 46, thereby preventing the rotation inward of inner skirts 52 about their attachment with security ring 34. In this manner, securing straps 42 prevent the removal of closure 2 without the fracture of frangible links 18, inasmuch as fractured frangible links 18 are visible to one observing closure 2, thereby inhibiting tampering with the contents of container 4.

Also in accordance with the objectives of the present invention, inner and outer protuberances 36 and 38 are of such dimension that virtually no clearance exists between nozzle 14 and inner surface 44 with inner skirts 52 interposed therebetween. As such, inner and outer protuberances 36 and 38 of inner skirts 52 inhibit tampering with the contents of container 4 by inhibiting the insertion of an object past inner skirts 52. Additionally, wing 40 extends upward past and in close proximity with outer edge 54 and wraps around and in close proximity with upper edge 56. Thus, in accordance with the objectives of the present invention, the arrangement of wing 40 in relation to stopping ledge 48 further inhibits tampering with the contents of container 4 by inhibiting the insertion of an object around and past stopping ledge 48.

The transition between nozzle 14 and security ring 12 may be curved to be complemental with the curvature of lower surface 35 to inhibit tampering with the contents of container 4. Additionally, security fins 60 inhibit the tampering of the contents of container 4 by inhibiting the insertion of an object between inner skirts 52 and inner surface 44 and by inhibiting the inward deflection of outer skirt 46.

Figure 6:
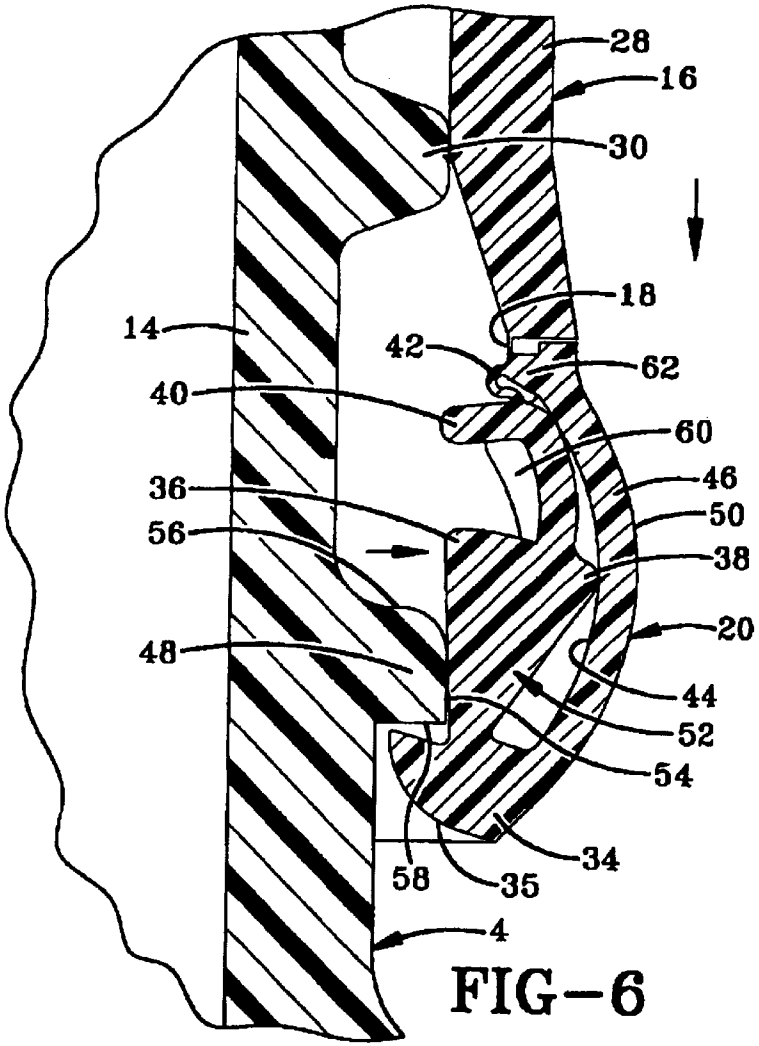
FIG. 6 is a sectional view similar to FIG. 5 depicting a second position during installation of the first embodiment on a bottle.
Figure 5:
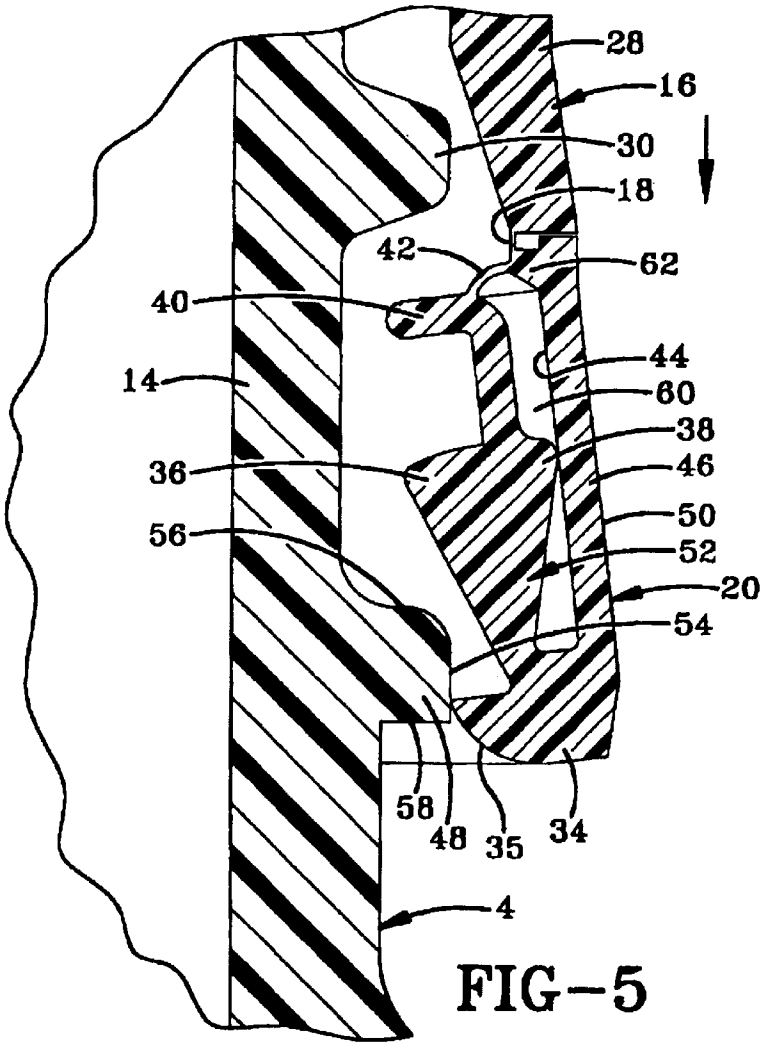
FIG. 5 is a sectional view depicting a first position of the first embodiment during installation of the first embodiment on a bottle.

Closure 2 is installed onto container 4 by placing it onto nozzle 14 as is shown in FIGS. 5–7. Closure 2 is shown in a first position in FIG. 5 wherein security ring 34 is passing over stopping ledge 48. In such configuration, security ring 34 is caused to stretch elastically in order to pass over stopping ledge 48. Security ring 34 is preferably of a cross-section sufficient to prevent plastic deformation or rupture os security ring 34 as it passes over stopping ledge 48.

Once security ring 34 has passed over stopping ledge 48, and inner protuberance 36 rests against outer edge 54, closure 2 is in the second position as is shown in FIG. 6. Since the surface of inner protuberance 36 is oblique to outer edge 54, when bottle closure 2 is in the second position inner skirts 52 are caused to rotate outward about security ring 34, thereby deflecting outer protuberance 38 against inner surface 44, and resulting in outward deflection of outer skirt 46 at its mid-section. As is shown in FIG. 6, when closure 2 is in the second position, the configuration of inner protuberance 36 and outer protuberance 38 results in outward deflection of outer skirt 46 without corresponding deflection of frangible links 18. Thus, the stresses encountered by frangible links 18 upon installation of closure 2 on container 4 are of a nature and magnitude insufficient to cause fracture of frangible links 18.

Closure 2 is shown fully installed on container 4 in FIG. 7. Inner protuberance 36 is disposed against nozzle 14 and lower edge 58, and wing 40 extends upwardly past outer edge 54 and rests against upper edge 56.

When cap 16 is first removed from container 4, the unthreading of cap portion 16 urges breakaway skirt 20 upwardly therewith. Simultaneously, lower edge 58 of stopping ledge 48 prevents the upward movement of inner protuberance 36, thereby retaining breakaway skirt 20 on container 4. Since cap portion 16 is caused to move away from breakaway skirt 20, frangible links 18 stretch and break (see FIG. 8) resulting in separation of cap portion 16 from breakaway skirt 20. Frangible links 18 thus constitute tamper indicators by indicating that cap 16 has been removed from nozzle 14 at least once. When cap 16 is removed from nozzle 14, frangible links 18 will become broken in the process. If cap 16 is then returned onto nozzle 14, frangible links 18 will remain in a broken condition. As such, a consumer who subsequently removes cap 16 from container 4 with the intent to consume the contents thereof will immediately notice the absence of breakage of frangible links 18 during the removal of cap 16. The consumer will thus be alerted to the fact that cap 16 previously has been removed on at least one occasion and that the contents of container 4 may have been tampered with.

Frangible links 18 thus provide evidence to a consumer that cap 16 has been removed from container 4 on at least one occasion. Moreover, security ring 34, inner skirts 52, and security fins 60 prevent a person from inserting a foreign object into the underside of closure 2 and removing closure 2 from container 4 without breaking frangible links 18. Closure 2 thus provides a tamper resistant bottle closure that protects the contents of container 4 from tampering and provides visual and tactile evidence to an unsuspecting consumer that such tampering has occurred.

Figure 9:
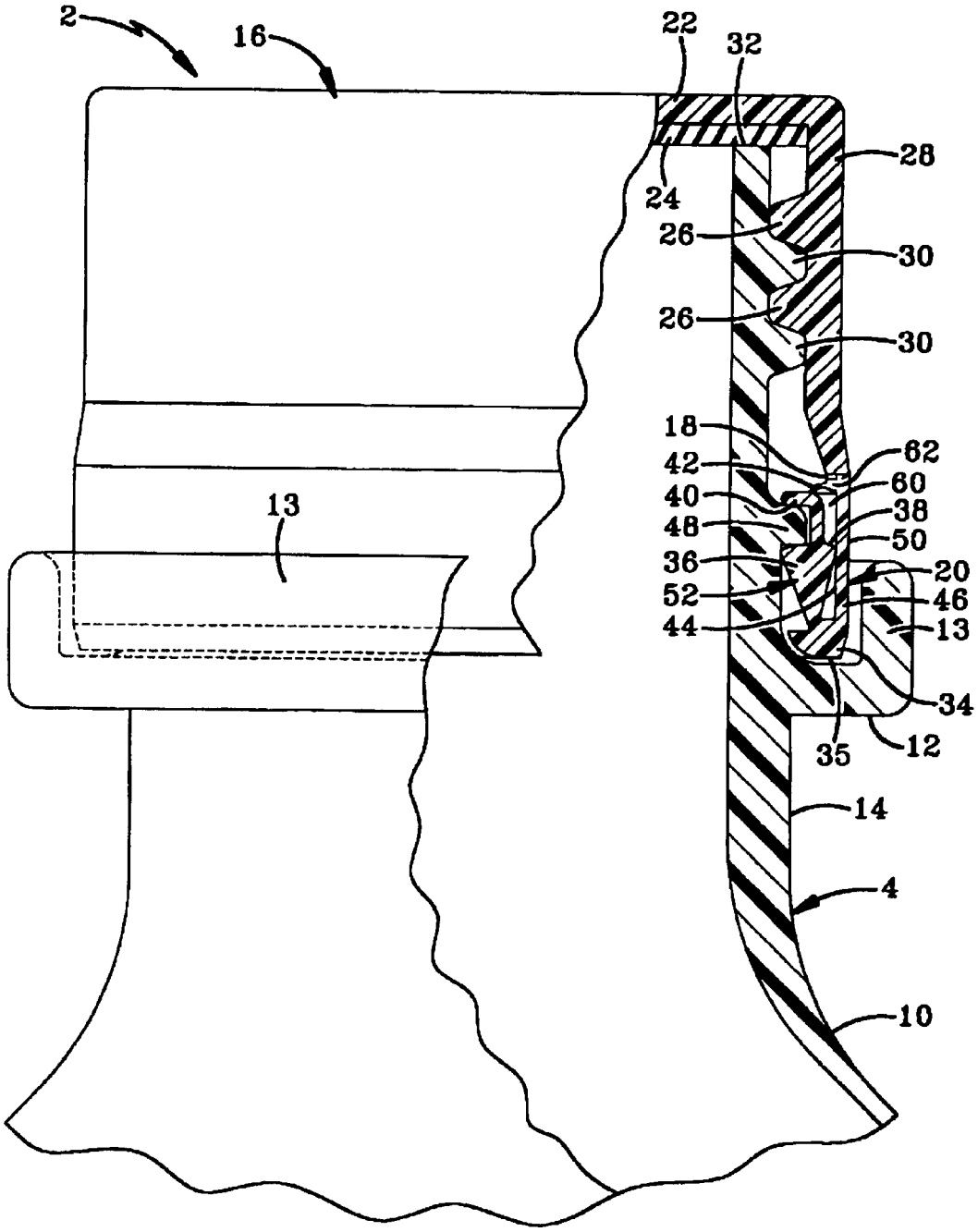
FIG. 9 is a sectional view of an alternative configuration of the first embodiment.

An alternative configuration of the present invention exists wherein container 4 further includes a security wall 13. Security wall 13 is an annular member projecting upwardly from security flange 12 and disposed a distance from nozzle 14 sufficient that closure 2 can be installed on container 4 with breakaway skirt 20 being interposed between security wall 13 and nozzle 14 (see FIG. 9). Security wall 13 may be formed integrally with security flange 12.

Figure 10:
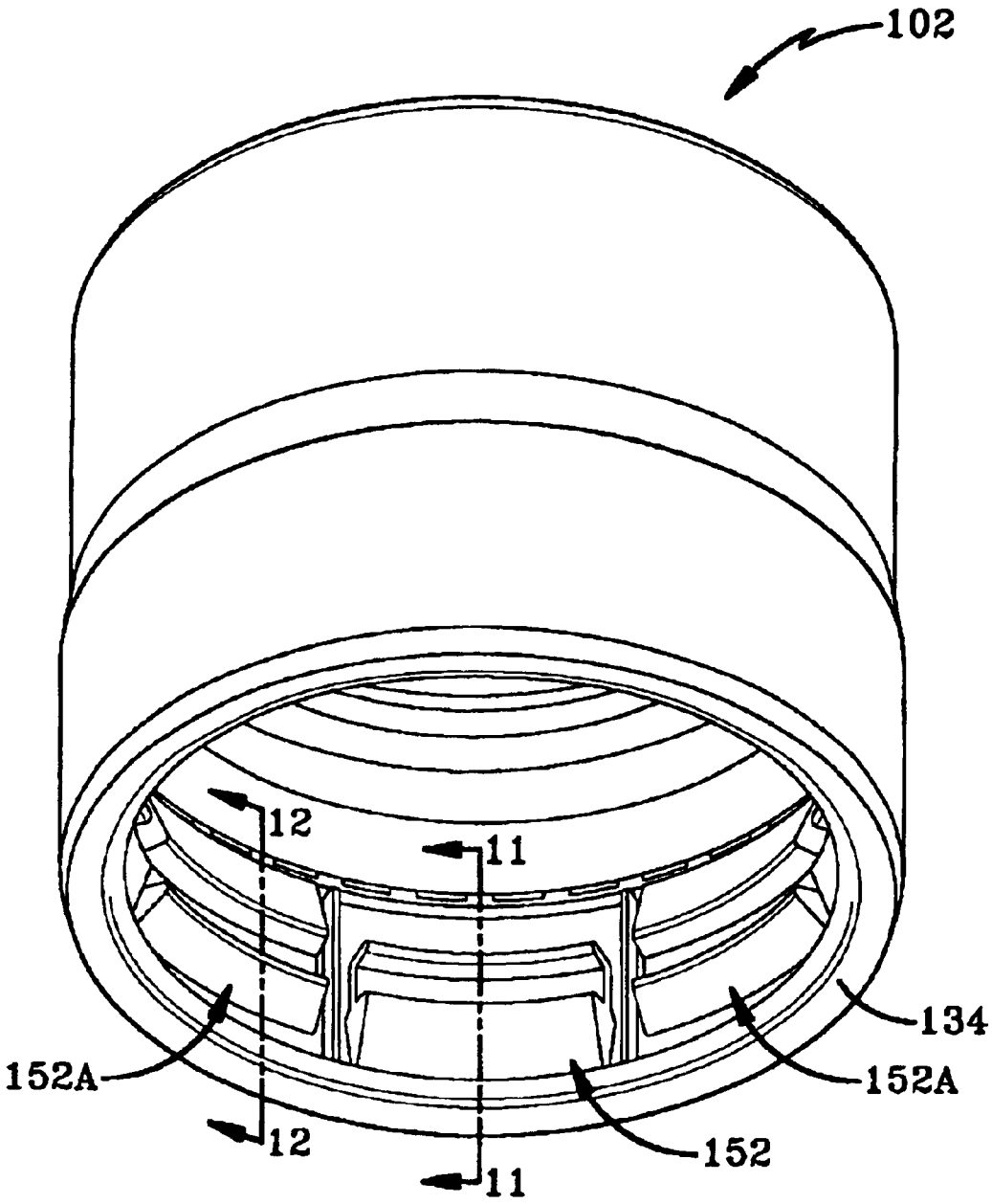
FIG. 10 is a perspective view of a second embodiment of the present invention wherein the underside of the second embodiment is shown.
Figure 11:
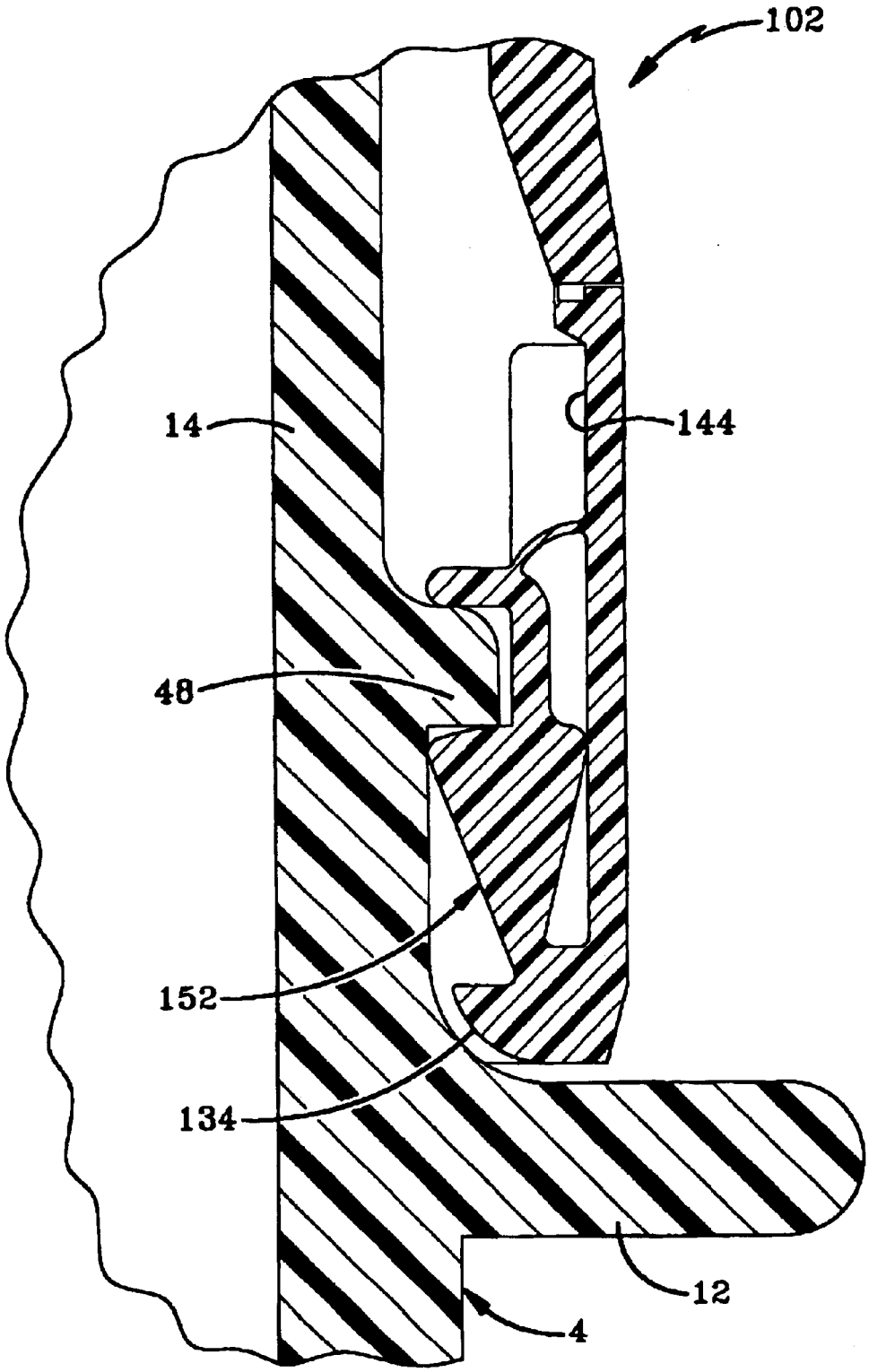
FIG. 11 is a sectional view as taken along line 11—11 of FIG. 10.
Figure 12:
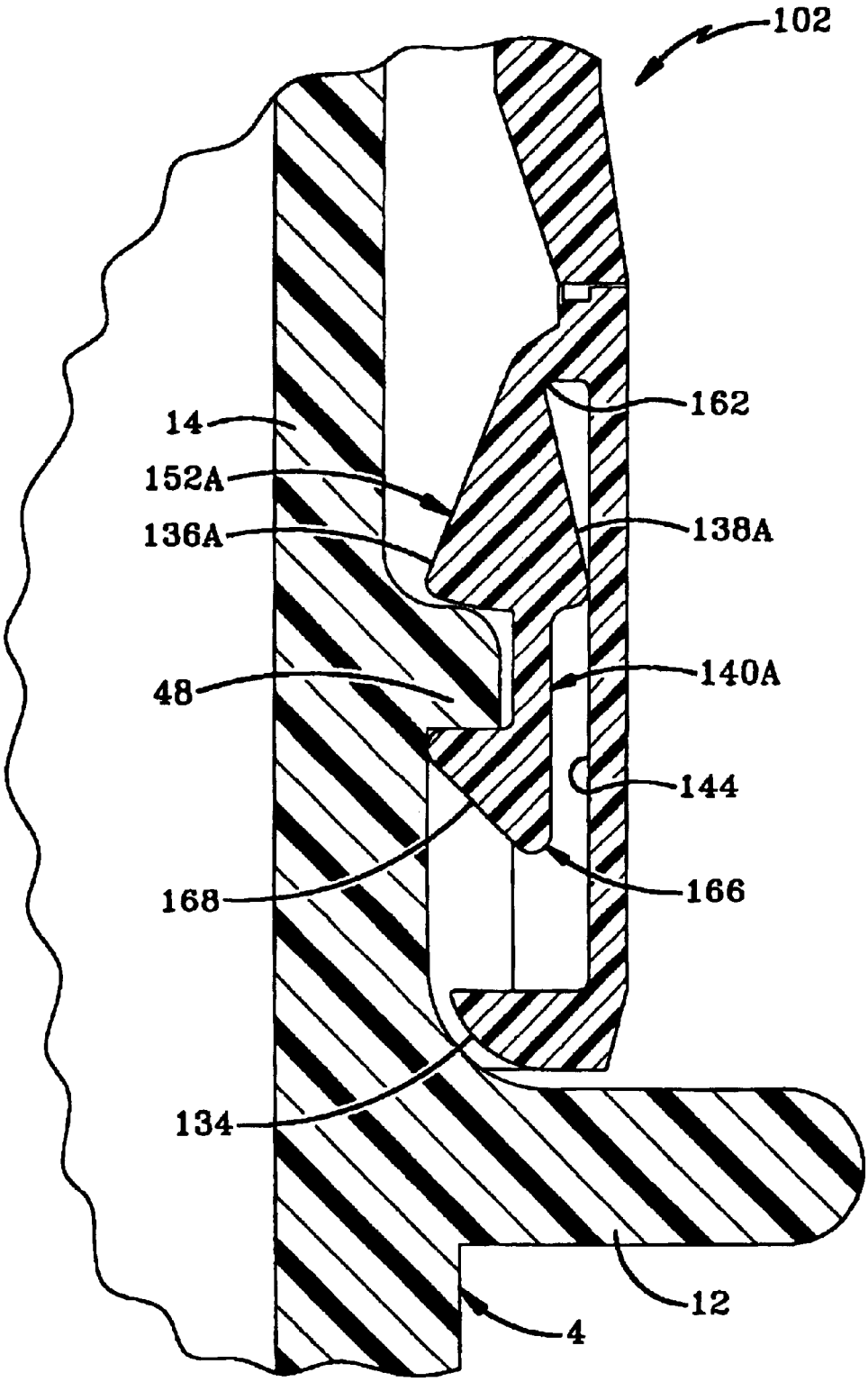
FIG. 12 is a sectional view as taken along line 12—12 of FIG. 10.

A second embodiment of the bottle closure of the present invention is indicated generally at the numeral 102 in FIGS. 10–12. Closure 102 is similar to closure 2, except that closure 102 includes a plurality of inner skirts 152 attached to security ring 134 as well as a plurality of inner skirts 152A attached to terminal flange 162. As can be seen in FIG. 10, inner skirts 152 alternate circumferentially with inner skirts 152A. As can be seen in FIG. 11, inner skirts 152 are essentially identical to inner skirts 52. As can be seen in FIG. 12, inner skirts 152A are similar to inner skirts 152, except are oriented upside-down as compared with inner skirts 152, are connected to terminal flange 162 instead of security ring 134, and each include an installation wedge 166A formed on wing 140A.

More specifically, inner skirts 152A each include an inner protuberance 136A facing toward nozzle 14, and outer protuberance 138A facing toward inner surface 144, and a wing 140A extending downwardly adjacent outer edge 54 and resting against lower edge 58. Installation wedge 166A formed on the lower surface of wing 140A includes an angled, substantially planar deflection face 168A that deflects inner skirt 152A in the outward direction during insertion of closure 102 onto containers. Closure 102 provides all of the benefits of closure 2, with the addition of providing inner skirts 152A with inner and outer protuberances 136A and 138A disposed above stopping ledge 48.

Figure 13:
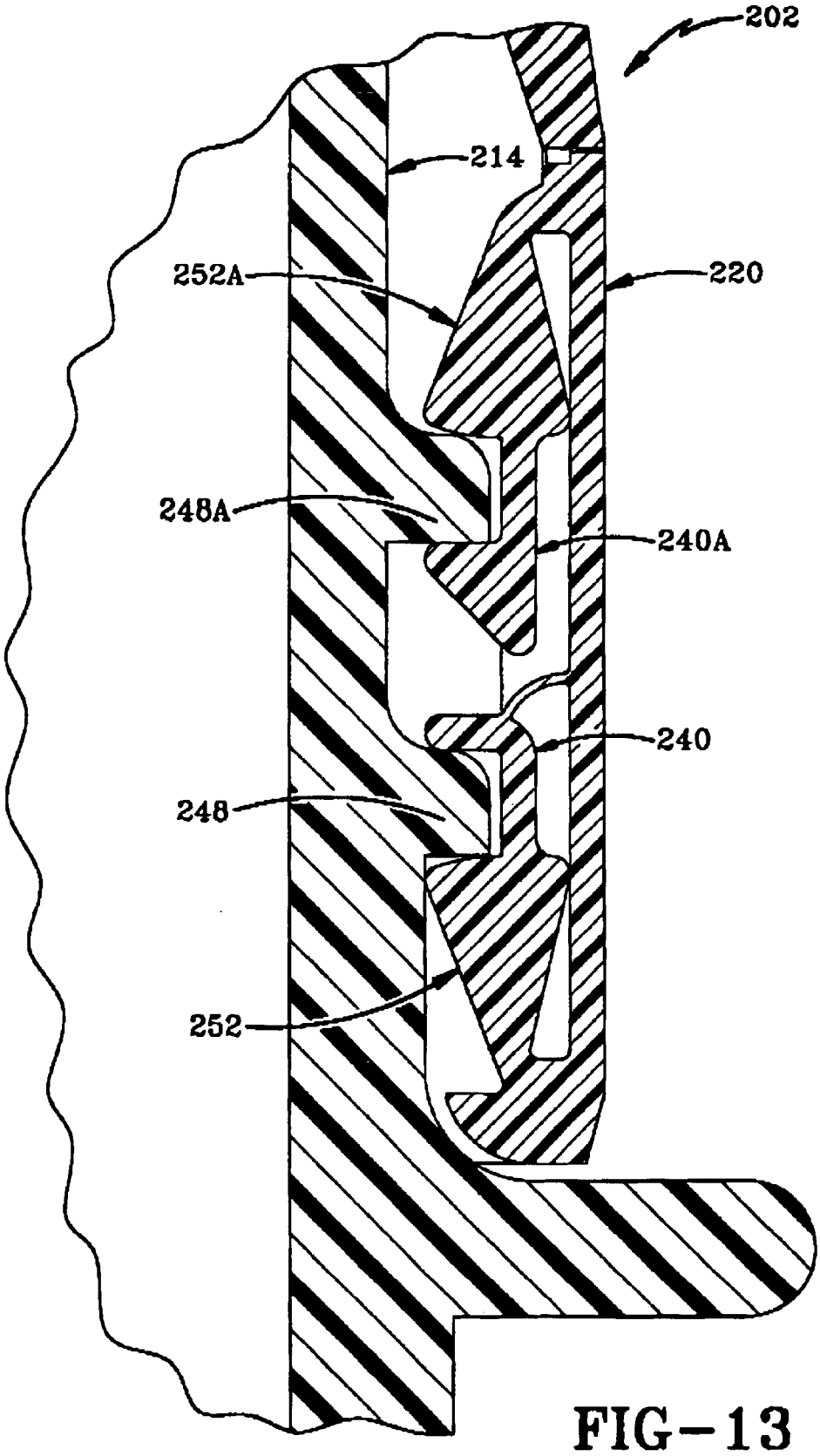
FIG. 13 is a sectional view of a third embodiment of the closure of the present invention installed on a bottle.

A third embodiment of the bottle closure of the present invention is indicated generally at the numeral 202 in FIG. 13. Closure 202 is similar to closure 102, except that instead of employing alternatingly-disposed skirts employs inner skirts 252 extending around stopping ledge 248 and a plurality of inner skirts 252A extending around a second stopping ledge 248A formed on nozzle 214. As can be seen in FIG. 13, inner skirts 252 and inner skirts 252A are each circumferentially distributed about breakaway skirt 20 instead of being alternately disposed with one another as with closure 102. Inner skirts 252 each are formed with a wing 240 that extends around stopping ledge 248. Inner skirts 252A are each disposed above inner skirts 252 and include a wing 240A that extends around a second stopping ledge 248A. Closure 202 thus provides the benefits of closure 102, plus additionally provides a second stopping ledge 248A and a set of inner skirts 252A to further prevent the insertion of foreign devices into the open end of closure 202.

Figure 14:
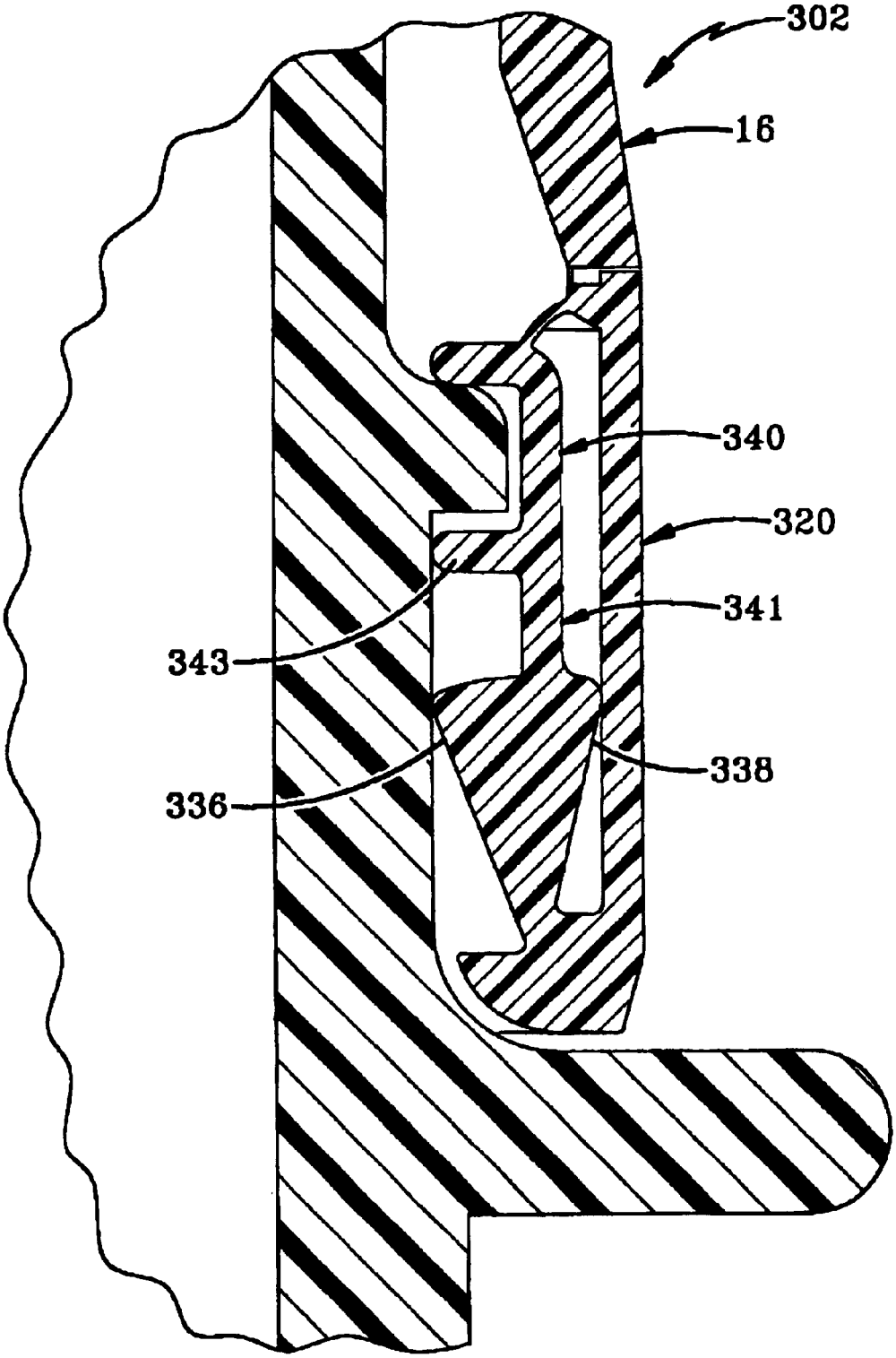
FIG. 14 is a sectional view of a fourth embodiment of the closure of the present invention installed on a bottle.

A fourth embodiment of the bottle closure is indicated generally at the numeral 302 in FIG. 14. Closure 302 is similar to closure 2, except that an intermediate link 341 is interposed between wing 340 and inner and outer protuberances 336 and 338. Intermediate link 341 extends upwardly from inner and outer protuberances 336 and 338 and includes a lower leg 343 that is disposed adjacent and is spaced slightly from lower edge 58 of stopping ledge 48. The space between lower edge 58 and lower leg 343 permits breakaway skirt 320 to rotate with cap 16 when cap 16 is unthreaded from nozzle 14. Additionally, the space between lower edge 58 and lower leg 343 prevents inadvertent breakage of frangible links 18 inasmuch as stopping ledge 48 is not tightly compressed between wing 340 and lower leg 343. Depending upon the configuration of frangible links 18 and the amount of tensile force that is required to break frangible links 18, frangible links 18 may remain unbroken until inner protuberance 336 compresses lower leg 343 against lower edge 58 during removal of cap 16. Such compression of lower leg 343 between inner protuberance 336 and lower edge 58 securely retains breakaway skirt 320 on nozzle 14 during and after removal of cap 16.

Figure 15:
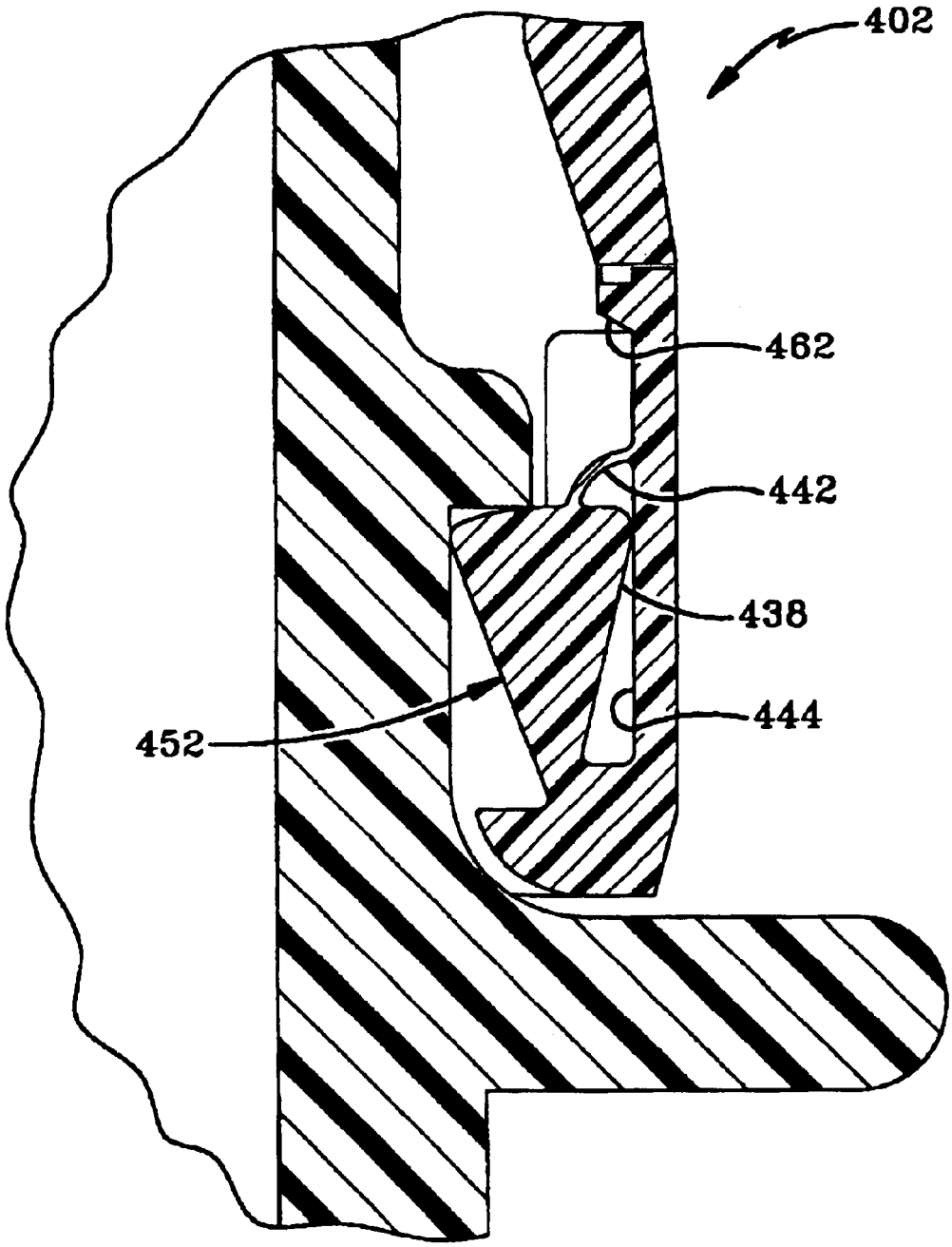
FIG. 15 is a sectional view of a fifth embodiment of the closure of the present invention installed on a bottle.

A fifth embodiment of the bottle closure of the present invention is indicated generally at the numeral 402 in FIG. 15. Closure 402 is similar to closure 2, except that inner skirt 452 does not include wing 40, and securing strap 442 extends between outer protuberance 438 and inner surface 444. Securing strap 442 thus has no connection with terminal flange 462. The connection of securing strap 442 between outer protuberance 438 and inner surface 444 prevents inner skirt 452 from being pried away from inner surface 444 by a foreign object inserted therebetween. The absence of wing 40 reduces the extent to which inner skirt 452 can be elastically deflected away from inner surface 444 without the fracture of frangible links 18. Closure 402 thus provides a level of security that is different than closure 2 by further preventing a foreign object from being inserted between outer protuberance 438 and inner surface 444.

Figure 17:
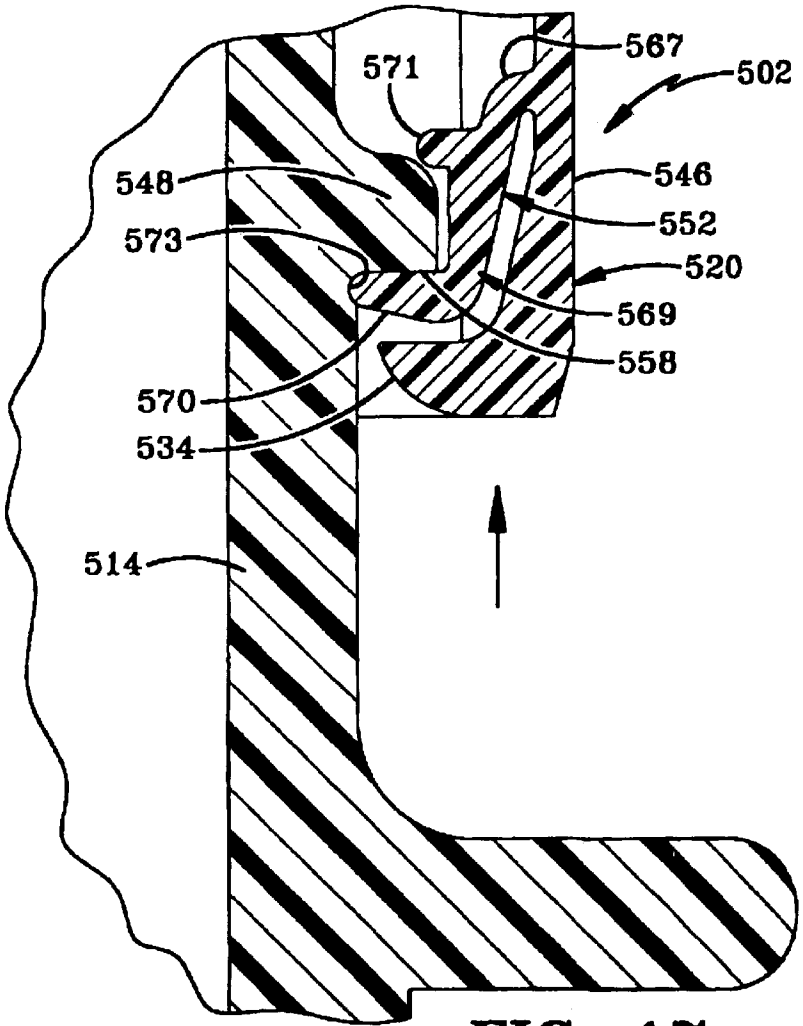
FIG. 17 is a sectional view of the sixth embodiment showing the stopping ledge received in the socket during removal of the cap portion.
Figure 16:
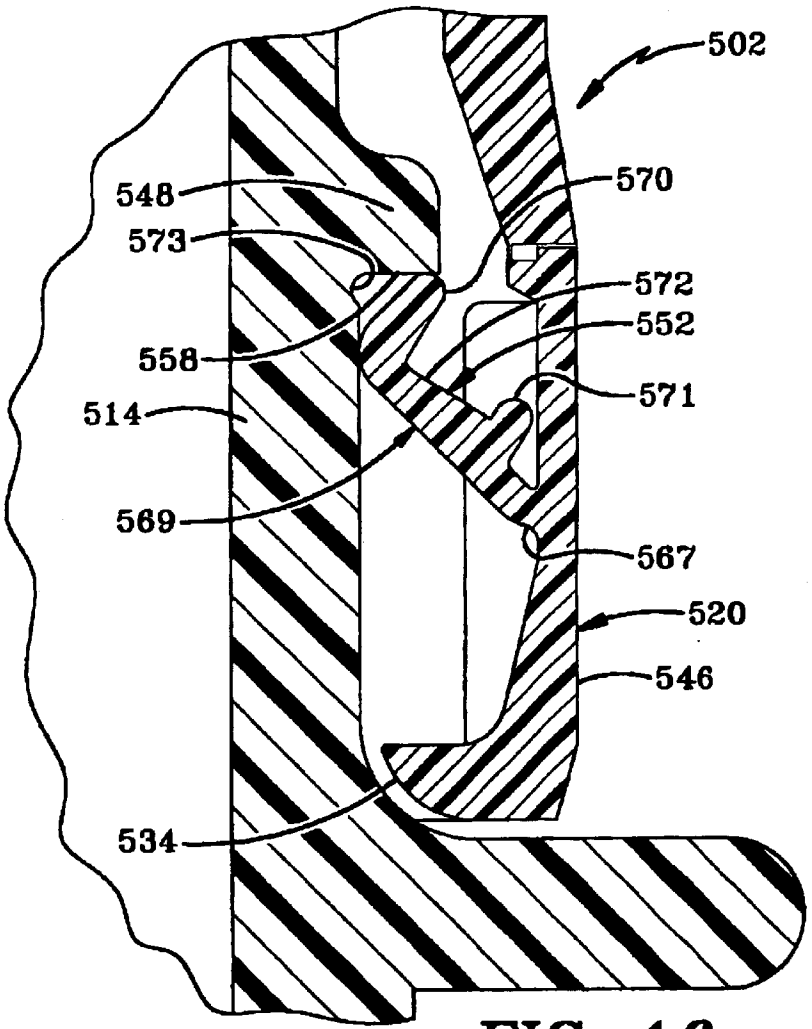
FIG. 16 is a sectional view of a sixth embodiment of the closure of the present invention installed on a bottle.

A sixth embodiment of the bottle closure of the present invention is indicated generally at the numeral 502 in FIGS. 16 and 17. Closure 502 is similar to closure 2, except that inner skirt 552 is of a different configuration than inner skirt 52, and nozzle 514 includes a recession that is absent from nozzle 14. More specifically, inner skirt 552 is attached to outer skirt 546 with a hinge 567. Inner skirt 552 includes an elongated arm 569 extending from hinge 567 that terminates at a blocking protrusion 570 and includes a clamping protrusion 571 interposed between blocking protrusion 570 and hinge 567. A channel 572 is defined by between blocking protrusion 570 and clamping protrusion 571 and includes the portion of arm 569 therebetween.

As can be seen in FIG. 16, when closure 502 is installed onto nozzle 514, blocking protrusion 570 rests against both nozzle 514 and lower edge 558 of stopping ledge 548. When closure 502 is unthreaded from nozzle 514, breakaway skirt 520 rises therewith, causing outer skirt 546 to rotate about hinge 567 until stopping ledge 548 is received in channel 572. With stopping ledge 548 received in channel 572, breakaway skirt 520 is securely retained on nozzle 14, thus causing frangible links 18 to fracture when cap 16 is removed from nozzle 514. As stopping ledge 548 is received in channel 572, inner skirt 552 has rotated sufficiently about hinge 567 that blocking protrusion 570 rotates and is received in a recession 573 formed on the outer surface of nozzle 514 adjacent and below lower edge 558 of stopping ledge 548. Closure 502 is still selectively rotatable on nozzle 514 when blocking protrusion 570 is received in recession 573. Additionally, the upward movement of breakaway skirt 520 ultimately causes security ring 534 to compress blocking protrusion 570 against lower edge 558, thus ensuring that breakaway skirt 520 is retained on nozzle 514 and facilitating the simultaneous breakage of frangible links 18. The engagement of stopping ledge 548 in channel 572 and/or the engagement of blocking protrusion 570 in recession 573 may additionally constitute an audible or tactile indicator to indicate that cap 16 is ready to be removed from nozzle 514.

Figure 18:
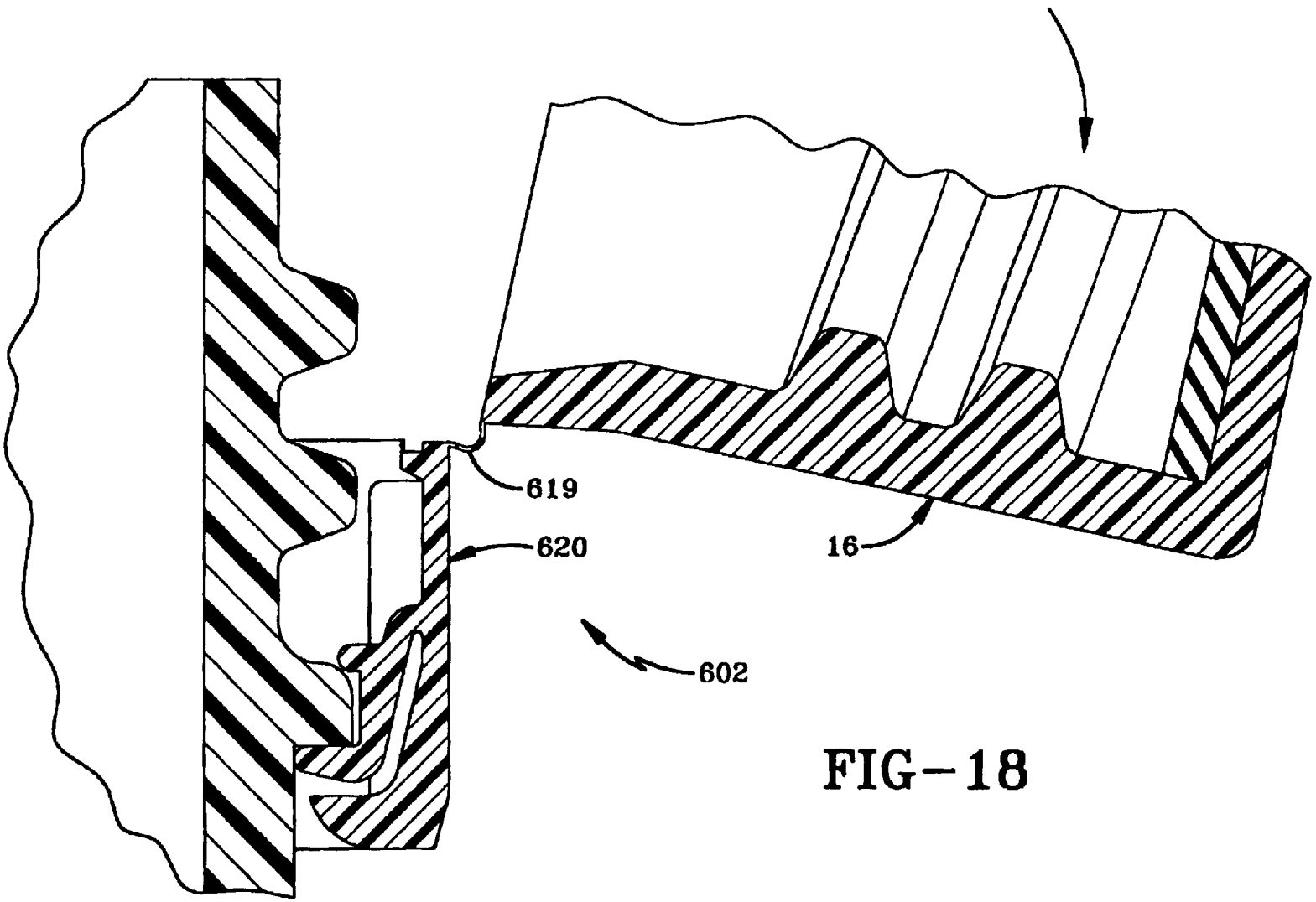
FIG. 18 is a sectional view of a seventh embodiment of the present invention showing the cap portion removed from the nozzle of the bottle.

A seventh embodiment of the bottle closure of the present invention is indicated generally at the numeral 602 in FIG. 18. Closure 602 is similar to closure 502, except that closure 602 additionally includes a connection strap 619 between cap 16 and breakaway skirt 620. Connection strap 619 ensures that cap 16 remains hingedly attached to breakaway skirt 620 despite the breakage of frangible links 18. Closure 602 thus provides all the benefits of closure 502, plus additionally ensures that cap 16 is not lost or misplaced by the user and thus can be rethreaded onto nozzle 14.

Accordingly, the improved bottle closure apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the tamper-resistant bottle closure is constructed and used, the characteristics of the construction, and the advantageous new and useful results obtained; the new and useful structures, devices, elements, arrangements, parts, and combinations are set forth in the appended claims.

Having thus described the invention, it is claimed:

1. A tamper-resistant bottle closure adapted to be carried on a container having a stopping ledge, said closure comprising:

a cap;

a breakaway skirt having an outer skirt and a plurality of first inner skirts inwardly disposed to said outer skirt;

a plurality of frangible links extending between said cap and said outer skirt;

a first wing disposed on each first inner skirt, each first wing adapted to lie adjacent the stopping ledge such that each first wing at least partially surrounds the stopping ledge, and each inner skirt is attached to said outer skirt at a location distal said frangible links; and a plurality of second inner skirts inwardly disposed to said outer skirt, each second inner skirt having a second wing disposed thereon, each second wing adapted to lie adjacent the stopping ledge such that each second wing at least partially surrounds the stopping ledge, each second inner skirt being attached to said outer skirt at a location proximate said frangible links.

2. The closure of claim 1, further comprising a securing strap extending between at least each first wing and said outer skirt.

3. A tamper-resistant bottle closure adapted to be carried on a container having a stopping ledge, said closure comprising:

a cap;

a breakaway skirt having an outer skirt and a plurality of first inner skirts inwardly disposed to said outer skirt;

a plurality of frangible links extending between said cap and said outer skirt;

a first wing disposed on each first inner skirt, each first wing adapted to lie adjacent the stopping ledge such that each first wing at least partially surrounds the stopping ledge, and each first inner skirt is attached to said outer skirt at a location distal said frangible links;

a plurality of second inner skirts inwardly disposed to said outer skirt, each second inner skirt having a second wing disposed thereon, each second wing adapted to lie adjacent the stopping ledge such that each second wing at least partially surrounds the stopping ledge, each second inner skirt being attached to said outer skirt at a location proximate said frangible links;

a securing strap extending between at least each first wing and said outer skirt; and an intermediate link having a lower leg, said intermediate link disposed adjacent each wing, said lower leg adapted to be disposed adjacent and spaced from the stopping ledge.

4. The closure of claim 3, further comprising an inner protuberance and an outer protuberance formed on each first inner skirt, said inner protuberance adapted to be disposed adjacent the container.

5. The closure of claim 3, further comprising a security ring, said security ring being attached to said outer skirt and adapted to be disposed adjacent the container.

6. The closure of claim 5, in which said security ring includes a curved lower surface.

7. The closure of claim 3, further comprising at least a first securing strap extending between each first inner skirt and said outer skirt.

8. The closure of claim 3, further comprising at least a first security fin connected to said outer skirt.

9. A tamper-resistant bottle closure adapted to be carried on a container having a stopping ledge, said closure comprising:

a cap;

a breakaway skirt having an outer skirt and a plurality of inner skirts inwardly disposed to said outer skirt;

a plurality of frangible links extending between said cap and said outer skirt;

each inner skirt being attached to said outer skirt at a location proximate said frangible links; and a wing disposed on each inner skirt, each wing extending downwardly and thereafter inwardly.

10. The closure of claim 9 wherein the downward extension of each wing is substantially parallel to the outer skirt and the inward extension of each wing is substantially perpendicular to the outer skirt.

11. The closure of claim 9 wherein each inner skirt further includes an inner and an outer protuberance; and the downward extension of each wing extends intermediate the inner and outer protuberance.

12. The closure of claim 9 wherein the inward extension has a substantially triangular cross section.

13. The closure of claim 9 wherein each wing is complementally shaped and lies adjacent the stopping ledge such that each wing at least partially surrounds the stopping ledge.

* * * * *